US005803877A

United States Patent [19]

Franey

[11] Patent Number: 5,803,877

[45] Date of Patent: Sep. 8, 1998

[54] PROGRAMMABLE SPARING PARTNER

[76] Inventor: Thomas Franey, 200 26th St., #Z-203, Atlanta, Ga. 30309

[21] Appl. No.: 604,025

[22] Filed: Feb. 20, 1996

[51] Int. Cl.[6] ..... A63B 69/00

[52] U.S. Cl. ..... 482/83; 482/87

[58] Field of Search ..... 482/83–89, 4

[56] References Cited

U.S. PATENT DOCUMENTS

| | | | |
|---|---|---|---|
| 2,012,899 | 8/1935 | Thorson | 482/87 |
| 3,813,095 | 5/1974 | Long | 272/78 |
| 4,512,568 | 4/1985 | Servadio | 272/78 |
| 4,534,557 | 8/1985 | Bigelow | 482/84 |
| 4,660,827 | 4/1987 | Servadio | 272/78 |
| 5,048,822 | 9/1991 | Murphy | 272/78 |

FOREIGN PATENT DOCUMENTS

| | | | |
|---|---|---|---|
| 1049072 | 10/1983 | U.S.S.R. | 482/83 |

*Primary Examiner*—Jerome Donnelly

[57] ABSTRACT

A punching bag is suspended from a from a motion device that moves the punching bag vertically and horizontally simulating the motions of an opponent boxer. The programmable sparing partner is operated from a control panel from which difficulty levels are selectable and feed back such as force of punch, number of punches, over all score are provided. The panel also has speed and motion controls. A free standing housing is described which is designed to be installed with modification to the building structure.

7 Claims, 6 Drawing Sheets

PROGRAMMABLE SPARING PARTNER

BACKGROUND OF THE INVENTION

1. Field of the Invention

The present invention relates to a punching bag or speed bag support device. More particularly, the present invention relates to a speed bag device that is evasively maneuverable.

2. Description of the Prior Art

Many devices are known to aid a boxer in training and exercising, including the punching bag. The known punching bags are mounted in a fixed manner to a floor, a ceiling, or special platform. Because these punching bags do not move, they can help train a boxer only so far, then the boxer needs a sparing partner. This use of a sparing partner is costly which limits the time most boxers can spend practicing in this manner.

There are two general types of punching bags; the speed bag which is suspended from an overhead and a body bag which is also suspended from an overhead. The speed bag rebounds off a overhead board when hit, changing direction and returning toward the boxer. The body bag is a padded dead weight which moves little when hit by a punch.

A patented invention shows a body mounted on a circular track with the body bag hanging by a non-ridged means from a car riding on the track. When the apparatus functions the motion of the device is effected by the inertia of the punching bag causing an un-natural motion that does not effectively simulate the expected move of a real boxer.

Another inventor shows a speed bag with a means of vertical movement which makes the punching bag move in a vertical direction. The movement functions as an adjustment means to regulate the return speed of the punching bag off the rebound board for the convenience of the boxer.

A need exists for an improved boxing simulation means incorporating dynamic movement both horizontally and vertically.

Numerous innovations for Programmable Sparing Partner have been provided in the prior art that are described as follows. Even though these innovations may be suitable for the specific individual purposes to which they address, they differ from the present invention as hereinafter contrasted.

U.S. Pat. No. 5,048,822, titled Simulated Sparring Apparatus and Method, invented by Richard Murphy comprises: a simulated sparring partner apparatus and method for the training and exercising of a boxer, including a track, a target article such as a body bag suspended from the track, and a control apparatus for controlling the speed and direction of movement of the carriage along the track. The drive may move the body bag at various speeds and in either direction. Also, the drive may be programmable such that the body bag follows a predetermined path at predetermined speeds. Alternative, motion of the body bag may be manual so as to allow a coach or trainer to control the motion of the bag.

The patented invention comprises a motorized carriage having a body bag suspended from a fixed length attachment means. The motion of the carriage is limited to forward, backward and stop at variable speeds controlled by an operator. The patented invention does not evasively move up and down. The present invention differs from the patented invention in that the present invention has a speed bag which moves on a track of predetermined shape. Further the speed bag may be moved up and down by a vertical movement means. The combined movement in the horizontal direction and vertical is controlled through a control panel and simulates the evasive movements of a boxer's opponent. The return means for the speed bag is a return spring.

In U.S. Pat. No. 4,512,568 an electrically operated rebound adjuster for a punching bag, comprises a reversible electric motor that by an adjustment means moves the punching bag up and down relative to a rebound board. This motion controls the rebound speed of the punching bag.

The patented invention is a rebound adjustment means for a punching bag of the speed bag type. The present invention differs from the patented invention in that the present invention has a speed bag which moves on a track of predetermined shape. Further the speed bag may be moved up and down by a vertical movement means. The combined movement in the horizontal direction and vertical is controlled through a control panel and simulates the evasive movements of a boxer's opponent. The return means for the speed bag is a return spring.

In U.S. Pat. No. 3,813,095 titled Punching Bag and Mount Therefor Including Automatic Spring Return for the Punching Bag, invented by Leo Long a punching bag is mounted on a support member that is in turn pivotally mounted in a slotted tube and limited to pivotal movement solely about the longitudinal axis of the slotted tube. The support member is spring loaded against a stop portion of the slotted tube so that the punching bag will automatically snap back directly to its normal position each time it is hit. A length adjustment means is fitted to one end of the tube to provide adjustment so the slotted tube may engage a pair of vertical support members such as a door jam.

The patented invention does not have a transverse or vertical movement means, it is fixed in position and does not simulate evasive movements of a boxers opponent. The present invention differs from the patented invention in that the present invention has a speed bag which moves on a track of predetermined shape. Further, the speed bag may be moved up and down by a vertical movement means. The combined movement in the horizontal direction and vertical is controlled through a control panel and simulates the evasive movements of a boxer's opponent. The return means for the speed bag is a return spring.

U.S. Pat. No. 4,660,827, titled Punching Bag Rebound Adjuster, invented by Robert Servadio comprises an electrically operated rebound adjuster for a punching bag. It has a reversible electric motor which rotates a vertically mounted screw-threaded spindle or shaft on the lower end of which a punching bag is supported so as to selectively raise and lower the position of the punching bag relative to a horizontal rebound board. This functions to speed up and slow down the response of the punching bag to a hit.

The patented invention is used to adjust the rebound speed of the punching bag. The present invention differs from the patented invention in that the present invention has a speed bag which moves on a track of predetermined shape. Further, the speed bag may be moved up and down by a vertical movement means. The combined movement in the horizontal direction and vertical is controlled through a control panel and simulates the evasive movements of a boxer's opponent. The return means for the speed bag is a return spring.

Numerous innovations for Programmable Sparing Partner have been provided in the prior art that are adapted to be used. Even though these innovations may be suitable for the specific individual purposes to which they address, they would not be suitable for the purposes of the present invention as heretofore described.

SUMMARY OF THE INVENTION

The purpose of the present invention is to fill a need of the prior art by providing a new apparatus which includes a target article such as a punching bag, a motion control means, and a support means. The Programmable Sparing Partner is suspended from an over head mounting means and further has a horizontal and vertical motion means which when taken together simulate the evasive action taken by an opposing boxer.

The horizontal motion means comprises a motor connected to retro linear reciprocating means that translated rotational motion into linear motion driving the target article (punching bag) along a preselected track.

The vertical motion means comprises a motor connected to one end of a cable. The opposite end of the cable is connected to a shaft being an extension of the punching bag. The shaft of the punching bag is constrained in the vertical position by a bearing which also functions as a transverse bearing for the horizontal motion. A return spring fastened to the cable and the transverse bearing opposes the cable so that as the cable is paid out and in the punching bag is lowered and raised. The return of the bag to a central position after being hit is regulated by a spring attached to the aforementioned shaft. The horizontal and vertical motion means response times effectively simulate the motion of an opposing boxer.

The types of problems encountered in the prior art is that training is limited on stationary equipment. Simulating an opposing boxer with the prior art equipment was inadequately implemented.. The 'body bag' and 'speed bag' are limited in training value because both types do not move evasively.

In the prior art, unsuccessful attempts to solve this problem were attempted namely a body bag mounted on a closed track. While this provided some evasiveness it was too predictable. The present invention improves the motion of target article by adding a vertical component and a track having a more complex path than a circle.

Innovations within the prior art are rapidly being exploited with proliferation of commercial fitness centers and equipment designed especially for home use.

The present invention went contrary to the teaching of the art by incorporating a spring functioning as the return mechanism for the speed bag and adding vertical motion.

The present invention solved a long felt need for simulation of an opponent boxer's movements with out the use of a real sparing partner.

The present invention produced unexpected results namely in professional fitness centers it requires less trainer intervention than the other types of boxing devices incorporating movement, because the control panel has feature designed to be operated by a boxer with gloves on.

Accordingly, it is an object of the present invention to provide evasiveness training and record accuracy of punches.

More particularly, it is an object of the present invention to provide force measurements of each punch.

In keeping with these objects, and with others which will become apparent hereinafter, one feature of the present invention resides, briefly stated, is the vertical motion of the punching bag.

When the programmable sparing partner (10) is designed in accordance with the present invention the boxer can be evaluated based on accuracy of hitting the target, force of the punch hitting the target and the number of punches delivered in an unit of time.

In accordance with another feature of the present invention is the transverse horizontal motion.

Another feature of the present invention is that the entire programmable sparing partner (10) can be installed in a free standing housing that does not require fastening to an overhead support.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10—programmable sparing partner (10)
12—support structure (12)
12A—left vertical support member (12A)
12B—right vertical support member (12B)
12C—motion control support member (12C)
12CA—motion control horizontal support member (12CA)
12CB—motion control vertical motor support (12CB)
12CC—motion control horizontal motor support (12CC)
12CD—motion control linear track (12CD)
14—target article (14)
14A—boxing bag (14A)
14AA—flex spring (14AA)
14AB—flex spring padding (14AB)
14AC—support eye (14AC)
14B—boxing bag impact sensor (14B)
14BA—boxing bag impact sensor data wire (14BA)
14C—boxing bag traverse motion (14C)
14D—boxing bag transport bearing (14D)
14DA—boxing bag upper vertical transport bearing (14DA)
14DB—boxing bag lower vertical transport bearing (14DB)
14DC—boxing bag upper horizontal transport bearing (14DC)
14DD—boxing bag lower horizontal transport bearing (14DD)
14E—boxing bag vertical column (14E)
14EA—boxing bag vertical column pulley support (14EA)
14F—boxing bag vertical motion (14F)
14G—boxing bag vertical return spring (14G)
14H—boxing bag shaft (14H)
16—drive means (16)
16A—drive means motor (16A)
16AA—drive means motor shaft (16AA)
16AB—drive means motor mounting flange (16AB)
16B—drive means motor control cable (16B)
16C—drive means rotational linkage (16C)
16CA—drive means rotational linkage motor coupling (16CA)
16CB—drive means rotational linkage linear coupling (16CB)
16D—drive means linear linkage (16D)
16DA—drive means linear linkage boxing bag coupling (16DA)
16E—drive means boxing bag vertical position control means (16E)
16EA—drive means boxing bag vertical position control cable (16EA)
16EB—drive means boxing bag vertical position control first pulley (16EB)
16EBA—drive means boxing bag vertical position control first pulley pin (16EBA)
16EC—drive means boxing bag vertical position control second pulley (16EC)

16ECA—drive means boxing bag vertical position control second pulley pin (16ECA)
16ED—drive means boxing bag vertical position control coupling attachment means (16ED)
16EE—drive means boxing bag vertical position control motor (16EE)
16EEA—drive means boxing bag vertical position control motor reel (16EEA)
16EEB—drive means boxing bag vertical position control motor flange (16EEB)
16EEC—drive means boxing bag vertical position control motor shaft (16EEC).
16EED—drive means boxing bag vertical position control motor control cable (16EED)
18—control panel (18)
18A—rear cover (18A)
18B—front panel (18B)
18BA—front panel punch force display (18BA)
18BB—front panel round display (18BB)
18BC—front panel score display (18BC)
18BD—front panel timer display (18BD)
18BE—front panel punch counter (18BE)
18BF—front panel speed control (18BF)
18BG—front panel starting means (18BG)
18BH—front panel stopping means (18BH)
18BI—front panel easy difficulty selection means (18BI)
18BJ—front panel moderate difficulty selection means (18BJ)
18BK—front panel hard difficulty selection means (18BK)
20A—programmable sparing partner fastenings (20A)
20B—drive means motor fastenings (20B)
20C—drive means boxing bag vertical position control motor fastenings (20C)
22—power means (22)
24—housing (24)
24A—housing vertical support (24A)
24B—housing horizontal support (24B)
24BA—housing horizontal support top cover (24BA)
24BAA—housing horizontal support target article motion slot (24BAA)
24BB—housing horizontal support lower member (24BB)
24C—housing base (24C)
212CA—second motion control horizontal support member (212CA)
212CB—second motion control vertical motor support (212CB)
212CC—second motion control horizontal motor support (212CC)
212CD—second motion control serpentine track (212CD)
312CA—third motion control horizontal support member (312CA)
312CB—third motion control vertical motor support (312CB)
312CC—third motion control horizontal motor support (312CC)
312CD—third motion control variable track (312CD)

BRIEF DESCRIPTION OF THE PREFERRED EMBODIMENT

DETAILED DESCRIPTION OF THE PREFERRED EMBODIMENT

Figure 1:
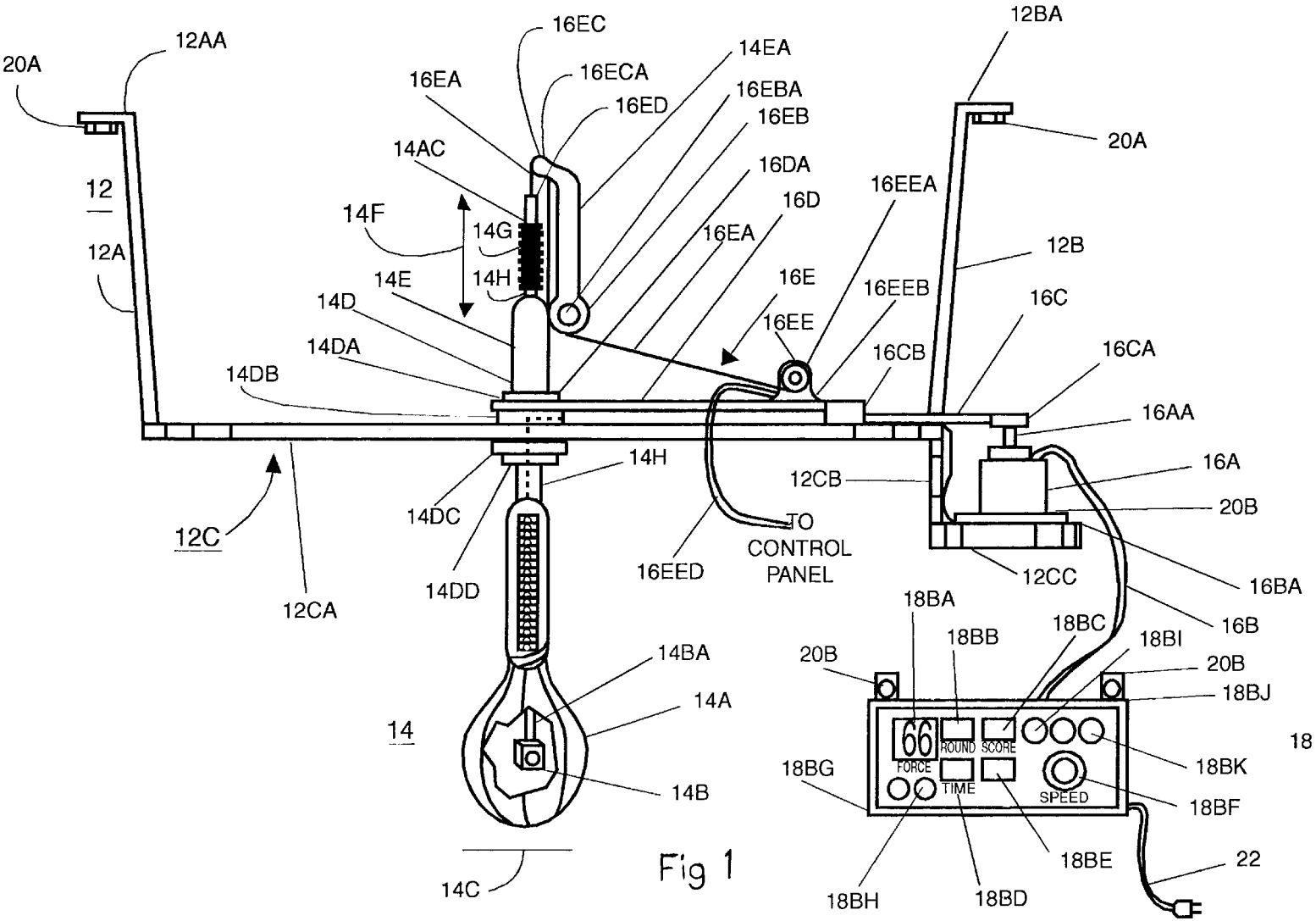
FIG. 1 is a side view of a programmable sparing partner showing a support structure, target article, drive means, and control panel.

Firstly, referring to FIG. 1 which is a side view of a programmable sparing partner exhibiting the following features; programmable sparing partner (10), support structure (12), left vertical support member (12A), right vertical support member (12B), motion control support member (12C), motion control horizontal support member (12CA), motion control vertical motor support (12CB), motion control horizontal motor support (12CC), motion control linear track (12CD), target article (14), boxing bag (14A), flex spring (14AA), flex spring padding (14AB), support eye (14AC), boxing bag impact sensor (14B), boxing bag impact sensor data wire (14BA), boxing bag traverse motion (14C), boxing bag transport bearing (14D), boxing bag upper vertical transport bearing (14DA), boxing bag lower vertical transport bearing (14DB), boxing bag upper horizontal transport bearing (14DC), boxing bag lower horizontal transport bearing (14DD), boxing bag vertical column (14E), boxing bag vertical column pulley support (14EA), boxing bag vertical motion (14F), boxing bag vertical return spring (14G), boxing bag shaft (14H), drive means (16), drive means motor (16A), drive means motor shaft (16AA), drive means motor mounting flange (16AB), drive means motor control cable (16B), drive means rotational linkage (16C), drive means rotational linkage motor coupling (16CA), drive means rotational linkage linear coupling (16CB), drive means linear linkage (16D), drive means linear linkage boxing bag coupling (16DA), drive means boxing bag vertical position control means (16E), drive means boxing bag vertical position control cable (16EA), drive means boxing bag vertical position control first pulley (16EB), drive means boxing bag vertical position control first pulley pin (16EBA), chive means boxing bag vertical position control second pulley (16EC), drive means boxing bag vertical position control second pulley pin (16ECA), drive means boxing bag vertical position control coupling attachment means (16ED), drive means boxing bag vertical position control motor (16EE), drive means boxing bag vertical position control motor reel (16EEA), drive means boxing bag vertical position control motor flange (16EEB), drive means boxing bag vertical position control motor shaft (16EEC), drive means boxing bag vertical position control motor control cable (16EED), drive means boxing bag vertical position control motor fastenings (20C), control panel (18), rear cover (18A), front panel (18B), front panel punch force display (18BA), front panel round display (18BB), front panel score display (18BC), front panel timer display (18BD), front panel punch counter (18BE), front panel speed control (18BF), front panel starting means (18BG), front panel stopping means (18BH), front panel easy difficulty selection means (18BI), front panel moderate difficulty selection means (18BJ), front panel hard difficulty selection means (1 8BK), programmable sparing partner fastenings (20A), drive means motor fastenings (20B), and power means (22).

The programmable sparing partner (10) comprises; a support structure (12), target article (14), drive means (16), control panel (18), and power means (22). The support structure (12) comprises a left vertical support member (12A) fastened on an upper distal end to an overhead attachment point by a programmable sparing partner fastening (20A). The left vertical support member (12A) is securely attached to a motion control support member (12C) on a lower distal end. A right vertical support member (12B) is securely fastened on an upper distal end to an overhead attachment point by a programmable sparing partner fastening (20A). The right vertical support member (12B) is securely fastened to the motion control support member (12C) on a lower distal end. The support structure (12) functions to position the programmable sparing partner (10) at an operable height from an over head support means.

The motion control support member (12C) comprises: a motion control horizontal support member (12CA) functioning as a mounting means for a target article (14) and drive means (16). The motion control horizontal support member (12CA) is securely fastened on a right distal end to an upper distal end of a motion control vertical motor support (12CB). The lower distal end of the motion control vertical motor support (12CB) is securely attached to a left distal end of a motion control horizontal motor support (12CC).

The motion control horizontal support member (12CA) further comprises a motion control linear track (12CD) (shown in FIG. 2) functioning to guide a target article (14) through a motion along a boxing bag traverse motion (14C) line. The target article (14) comprises: a boxing bag (14A) securely attached to a flex spring (14AA). The flex spring (14AA) functions to provide resistance to punches and returns the boxing bag (14A) to a starting position. The flex spring (14AA) is enwrapped by a flex spring padding (14AB) functioning to protect the spring from damage.

A boxing bag impact sensor (14B) is mounted inside the boxing bag (14A) functioning to measure the force exerted by each punch. The force measurement is sent to the front panel punch force display (18BA) by a boxing bag impact sensor data wire (14BA). The boxing bag impact sensor data wire (14BA) is attached at one distal end to the boxing bag impact sensor (14B).

The boxing bag (14A) is securely attached to a lower distal end of a flex spring (14AA). The upper distal end of the flex spring (14AA) is securely attached to a lower distal end of a boxing bag shaft (14H), an upper distal end of the boxing bag shaft (14H) is securely attached to a lower distal end of a support eye (14AC). The lower distal end of a support eye (14AC) is further securely attached to an upper distal end of a lower distal boxing bag vertical return spring (14G). The opposite distal end of the boxing bag vertical return spring (14G) is securely attached to the upper distal end of the boxing bag vertical column (14E). The boxing bag vertical return spring (14G) functions to force the boxing bag shaft (14H) downwardly when the tension on the drive means boxing bag vertical position control cable (16EA) is relaxed.

The boxing bag shaft (14H) is slidably attached to the boxing bag upper vertical transport bearing (14DA) and boxing bag lower vertical transport bearing (14DB). The upper distal end of the support eye (14AC) is attached to a drive means (16) which functions to provide up/down motion along a boxing bag vertical motion (14F) line to the boxing bag (14A) making the boxing bag (14A) difficult to hit.

The boxing bag transport bearing (14D) is slidably attached to a motion control linear track (12CD) and comprises: a boxing bag upper horizontal transport bearing (14DC) securely attached to a boxing bag lower horizontal transport bearing (14DD) functioning as a low friction interface between the target article (14) and the motion control linear track (12CD). The boxing bag transport bearing (14D) further comprises a boxing bag upper vertical transport bearing (14DA) securely attached at a lower distal end to a boxing bag lower vertical transport bearing (14DB). The boxing bag transport bearing (14D) functions as a low friction interface and a guide for the boxing bag shaft (14H) which moves along a boxing bag vertical motion (1 4F) as controlled by the drive means (16). The upper distal end of boxing bag upper vertical transport bearing (14DA) is securely attached to a boxing bag vertical column (14E) having a boxing bag vertical column pulley support (14EA) functioning as an attachment point for a drive means boxing bag vertical position control first pulley (16EB) and a drive means boxing bag vertical position control second pulley (16EC).

A drive means (16) comprises: a drive means motor (16A), a drive means motor control cable (16B), a drive means rotational linkage (16C), a drive means linear linkage (16D), and a drive means boxing bag vertical position control means (16E). The drive means (16) functions to move the target article (14) vertically and horizontally making the target article (14) more difficult to hit. A drive means motor (16A) is securely attached at a lower distal end to a drive means motor mounting flange (16AB). The drive means motor mounting flange (16AB) is securely attached to the motion control horizontal motor support (12CC) by a plurality of drive means motor fastenings (20B). The upper distal end of the drive means motor (16A) comprises a drive means motor shaft (16AA) securely attached to a drive means rotational linkage motor coupling (16CA) which is securely attached to one distal end of a drive means rotational linkage (16C). The opposite distal end of the drive means rotational linkage (16C) is rotationally attached to a drive means rotational linkage linear coupling (16CB) which is rotationally attached to one distal end of a drive means linear linkage (16D). The opposite distal end of the drive means linear linkage (16D) is rotationally attached to a drive means linear linkage boxing bag coupling (16DA) which is securely affixed to the boxing bag upper vertical transport bearing (14DA).

Securely fastened to the drive means linear linkage (16D) by a plurality of drive means boxing bag vertical position control motor fastenings (20C) is a drive means boxing bag vertical position control motor flange (16EEB). The drive means boxing bag vertical position control motor flange (16EEB) is securely attached to a drive means boxing bag vertical position control motor (16EE) rotationally attached to a drive means boxing bag vertical position control motor shaft (16EEC). The drive means boxing bag vertical position control motor shaft (16EEC) is securely attached to a drive means boxing bag vertical position control motor reel (16EEA).

The drive means boxing bag vertical position control motor (16EE) is electronically connected to a drive means boxing bag vertical position control motor control cable (16EED). Electronic signals are sent from the control panel (18) which function to make the drive means boxing bag vertical position control motor (16EE) run forward or backwards which rotates the drive means boxing bag vertical position control motor shaft (16EEC) and the drive means boxing bag vertical position control motor reel (16EEA). The rotational movement of the drive means boxing bag vertical position control motor reel (16EEA) pays in and out the drive means boxing bag vertical position control cable (16EA) functioning to move the target article (14) up and down along the boxing bag vertical motion (14F).

The drive means boxing bag vertical position control motor reel (16EEA) is securely attached to a drive means boxing bag vertical position control cable (16EA) on one distal end. The drive means boxing bag vertical position control cable (16EA) at a first medial point is wound about a drive means boxing bag vertical position control first pulley (16EB) which is rotationally attached to a boxing bag vertical column pulley support (14EA) by a drive means boxing bag vertical position control first pulley pin (16EBA). The drive means boxing bag vertical position control cable (16EA) at a second medial point is wound about a drive means boxing bag vertical position control second pulley (16EC) which is rotationally attached to a boxing bag vertical column pulley support (14EA) by a drive means boxing bag vertical position control second pulley pin (16ECA). The opposite distal end of the drive means boxing bag vertical position control cable (16EA) is securely attached to a drive means boxing bag vertical position control coupling attachment means (16ED) which is securely attached to a support eye (14AC).

The drive means boxing bag vertical position control motor control cable (16EED) is electronically connected to a control panel (18) comprising: a rear cover (18A) securely attached to a front panel (18B).

The front panel (18B) comprises a rear cover (18A) removably attached to the front panel (18B). The front panel (18B) functions as a mounting means for indication and control means. The front panel (18B) comprises a front panel punch force display (18BA) securely mounted thereon, functioning to display the force of each punch delivered to the boxing bag (14A).The front panel (18B) comprises a front panel round display (18BB) securely mounted thereon, functioning to display the round number. The front panel (18B) comprises a front panel score display (18BC) securely mounted thereon, functioning to display the score the user receives. The front panel (18B) comprises a front panel timer display (18BD) securely mounted thereon, functioning to display the time remaining in a round. The front panel (18B) comprises a X securely mounted thereon, functioning to display the front panel punch counter (18BE) functioning to count the number of punches. The front panel (18B) comprises a front panel speed control (18BF) securely mounted thereon, functioning to display the speed of movement at which the target article (14) progresses along the motion control linear track (12CD). The front panel (18B) comprises a front panel starting means (18BG) securely mounted thereon, functions to turn on the programmable sparing partner (10). The front panel (18B) comprises a front panel stopping means (18BH) securely mounted thereon, functions to turn off the programmable sparing partner (10). The front panel (18B) comprises a front panel easy difficulty selection means (18BI) securely mounted thereon, functions to select an easy difficulty mode. The front panel (18B) comprises a front panel moderate difficulty selection means (18BJ) securely mounted thereon, functions to select a moderate difficulty mode. The front panel (18B) comprises a front panel hard difficulty selection means (18BK) securely mounted thereon, functions to select a hard difficulty mode.

A power means (22) is electronically connected to the control panel (18) functioning to provide electrical power to the programmable sparing partner (10).

Figure 2:
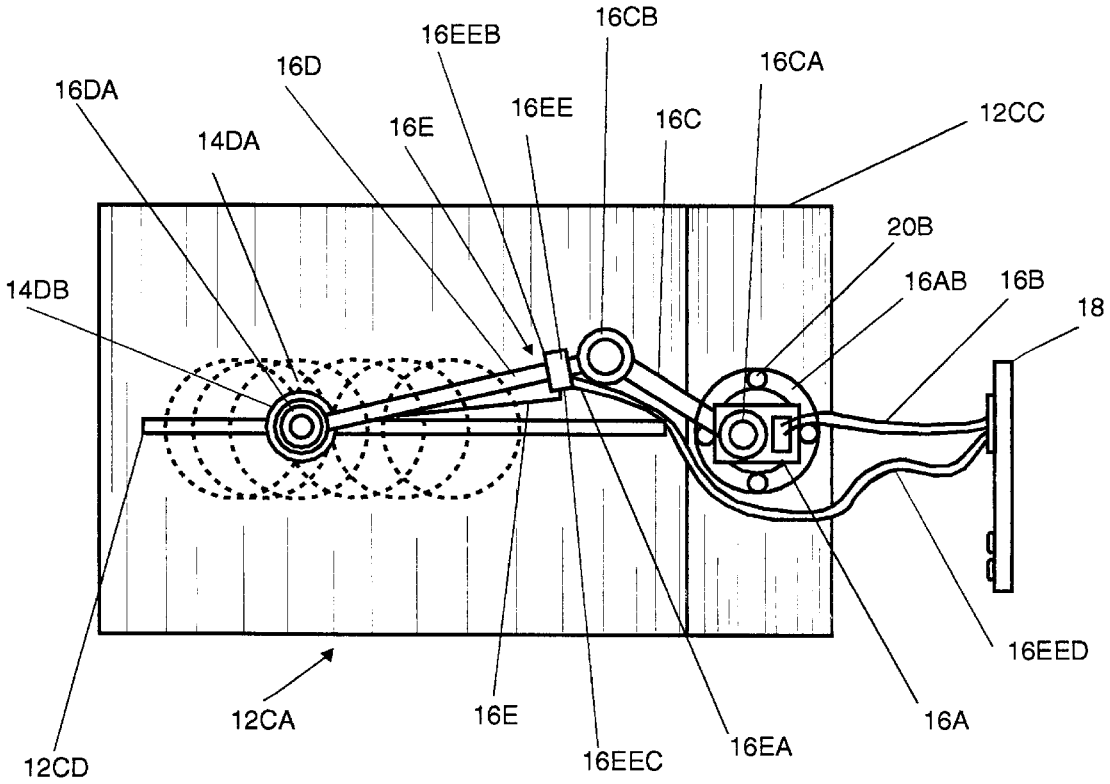
FIG. 2 is a top view of a support structure having a linear track and a drive means.

Secondly, referring to FIG. 2 which is a top view of a support structure having a linear track and a drive means, exhibiting the following features: motion control support member (12C), motion control horizontal support member (12CA), motion control vertical motor support (12CB), motion control horizontal motor support (12CC), motion control linear track (12CD), boxing bag transport bearing (14D), boxing bag upper vertical transport bearing (14DA), boxing bag upper horizontal transport bearing (14DC), drive means motor (16A), drive means motor shaft (16AA), drive means motor mounting flange (16AB), drive means motor control cable (16B), drive means rotational linkage (16C), drive means rotational linkage motor coupling (16CA), drive means rotational linkage linear coupling (16CB), drive means linear linkage (16D), drive means linear linkage boxing bag coupling (16DA), drive means boxing bag vertical position control means (16E), drive means boxing bag vertical position control cable (1 6EA), drive means boxing bag vertical position control motor (16EE), drive means boxing bag vertical position control motor reel (16EEA), drive means boxing bag vertical position control motor flange (16EEB), drive means boxing bag vertical position control motor shaft (16EEC), drive means boxing bag vertical position control motor control cable (16EED), and control panel (18).

The motion control support member (12C) comprises: a motion control horizontal motor support (12CC) is securely attached to a motion control vertical motor support (12CB) which functions to support a motion control horizontal support member (12CA). The motion control horizontal support member (12CA) is securely attached to a drive means motor mounting flange (16AB) by a plurality of drive means motor fastenings (20B). The drive means motor mounting flange (16AB) is securely fastened to a drive means motor (16A). The drive means motor (16A) is rotationally attached to a drive means motor shaft (16AA) having a drive means rotational linkage motor coupling (16CA) securely fastened thereon. The drive means motor control cable (16B) is attached at one distal end to the drive means motor (16A), the opposite distal end is electronically connected to the control panel (18). The drive means motor control cable (16B) functions to carry control signals to the drive means motor (16A). The drive means motor (16A) rotates the drive means rotational linkage (16C) which is rotationally fastened to the drive means rotational linkage linear coupling (16CB). The drive means rotational linkage linear coupling (16CB) is rotationally fastened to one distal end of the drive means linear linkage (16D). The opposite distal end of the drive means linear linkage (16D) is rotationally attached to the drive means linear linkage boxing bag coupling (16DA) which is securely attached to the boxing bag transport bearing (14D). The boxing bag transport bearing (14D) comprises a boxing bag upper vertical transport bearing (14DA) and boxing bag upper horizontal transport bearing (14DC) which slidably constrained the boxing bag transport bearing (14D) to the motion control linear track (12CD). The drive means (16) functions to move the target article (14) along the motion control linear track (12CD) in response to control signals from the control panel (18).

The drive means (16) further comprises: the drive means boxing bag vertical position control means (16E) having the drive means boxing bag vertical position control motor (16EE) securely attached to the drive means boxing bag vertical position control motor flange (16EEB) which is securely fastened to the drive means linear linkage (16D) by the drive means boxing bag vertical position control motor fastenings (20C).

The drive means boxing bag vertical position control motor (16EE) is rotationally attached to the drive means boxing bag vertical position control motor shaft (16EEC) which is securely fastened to the drive means boxing bag vertical position control motor reel (16EEA). One distal end of the drive means boxing bag vertical position control cable (16EA) is wound about the drive means boxing bag vertical position control motor reel (16EEA). The opposite distal end of the drive means boxing bag vertical position control cable (16EA) is securely fastened to the drive means boxing bag vertical position control coupling attachment means (16ED) which is securely fastened to the support eye (14AC) of the target article (14).

Control signals sent from the control panel (18) via the drive means boxing bag vertical position control motor control cable (16EED) cause the motor drive means boxing bag vertical position control motor shaft (16EEC) to rotate the drive means boxing bag vertical position control motor reel (16EEA), which functions to pay in and pay out the drive means boxing bag vertical position control cable (16EA) causing the boxing bag (14A) to move up and down.

Figure 3:
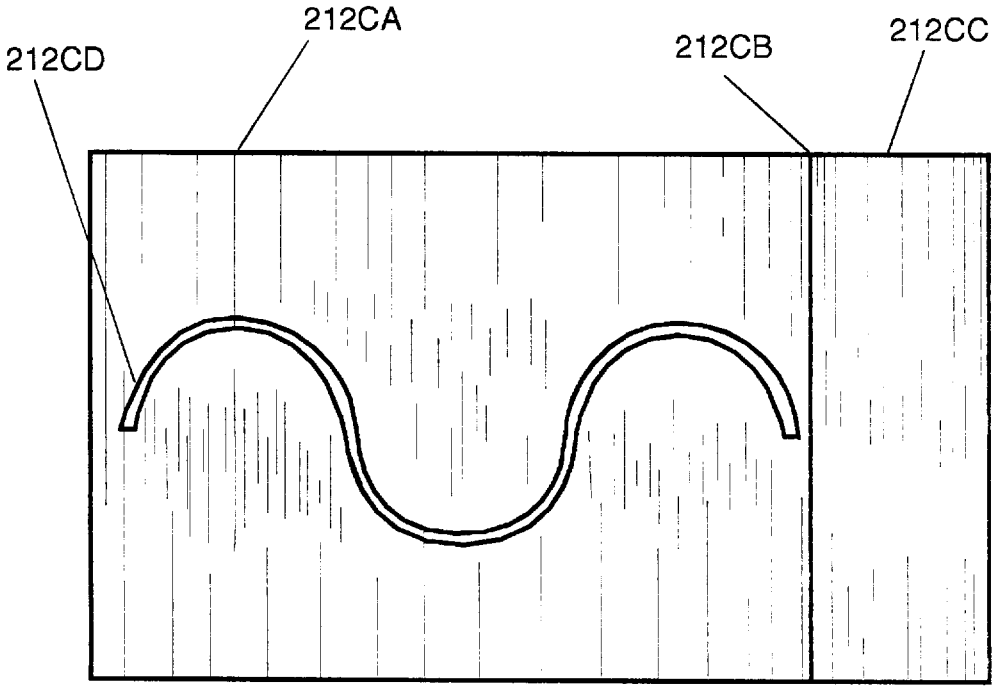
FIG. 3 is a top view of a second support structure having a motion control serpentine track.

Now, referring to FIG. 3 which is a top view of a second support structure similar to FIG. 2 exhibiting alternative embodiment of a motion control linear track exhibiting the following features: second motion control horizontal support member (212CA), second motion control vertical motor support (212CB), second motion control horizontal motor support (212CC), and second motion control serpentine track (212CD).

A second motion control horizontal support member (212CA) is an alternative to the motion control horizontal support member (12CA). The second motion control horizontal support member (212CA) is securely attached to a second motion control vertical motor support (212CB) which is securely attached to a second motion control horizontal motor support (212CC). The second motion control horizontal support member (212CA) further comprises a second motion control serpentine track (212CD) which functions to provide a variable motion to the target article (14) making the boxing bag (14A) more difficult for the user to hit.

Figure 4:
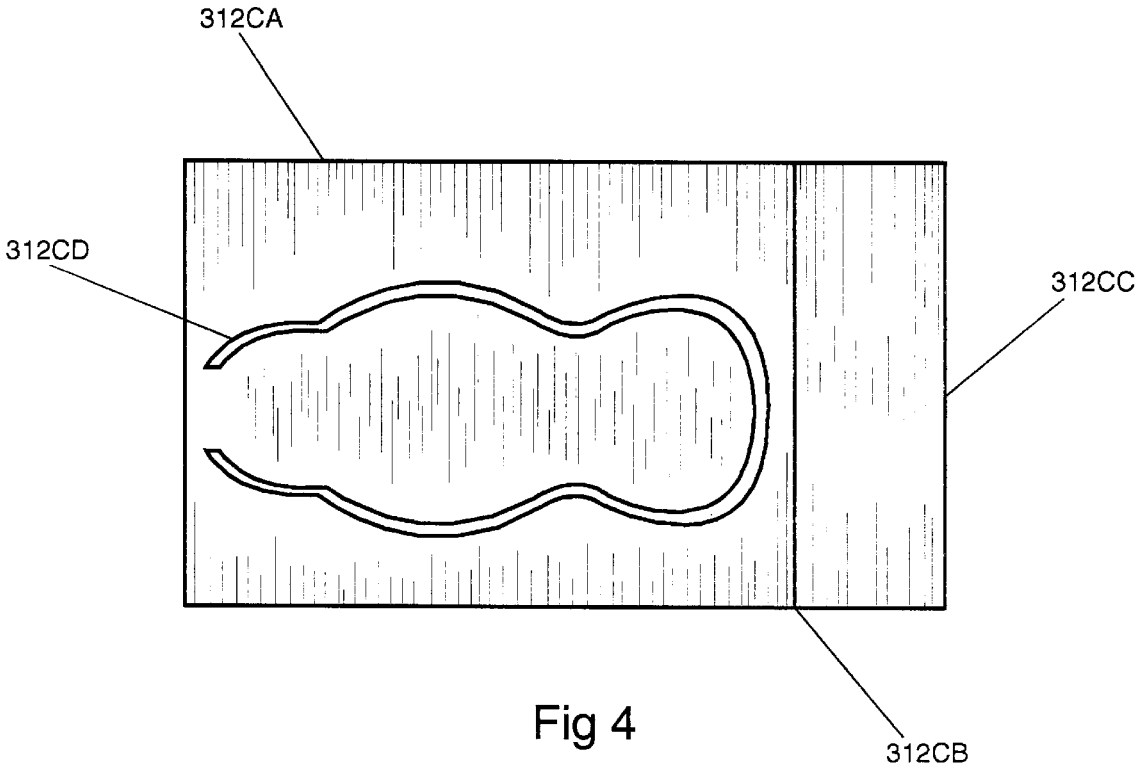
FIG. 4 is a top view of a third support structure having a motion control variable track.

Referring to FIG. 4 which is a top view of a third support structure similar to FIG. 2 exhibiting an alternative embodiment of a motion control linear track exhibiting the following features: third motion control horizontal support member (312CA), third motion control vertical motor support (312CB), third motion control horizontal motor support (312CC), and third motion control variable track (312CD).

A third motion control horizontal support member (312CA) is an alternative to the motion control horizontal support member (12CA). The third motion control horizontal support member (312CA) is securely attached to a third motion control vertical motor support (312CB) which is securely attached to a motion control horizontal motor support (312CC). The third motion control horizontal support member (312CA) further comprises a third motion control variable track (312CD)) which functions to provide a variable motion to the target article (14) making the boxing bag (14A) more difficult for the user to hit.

Figure 5:
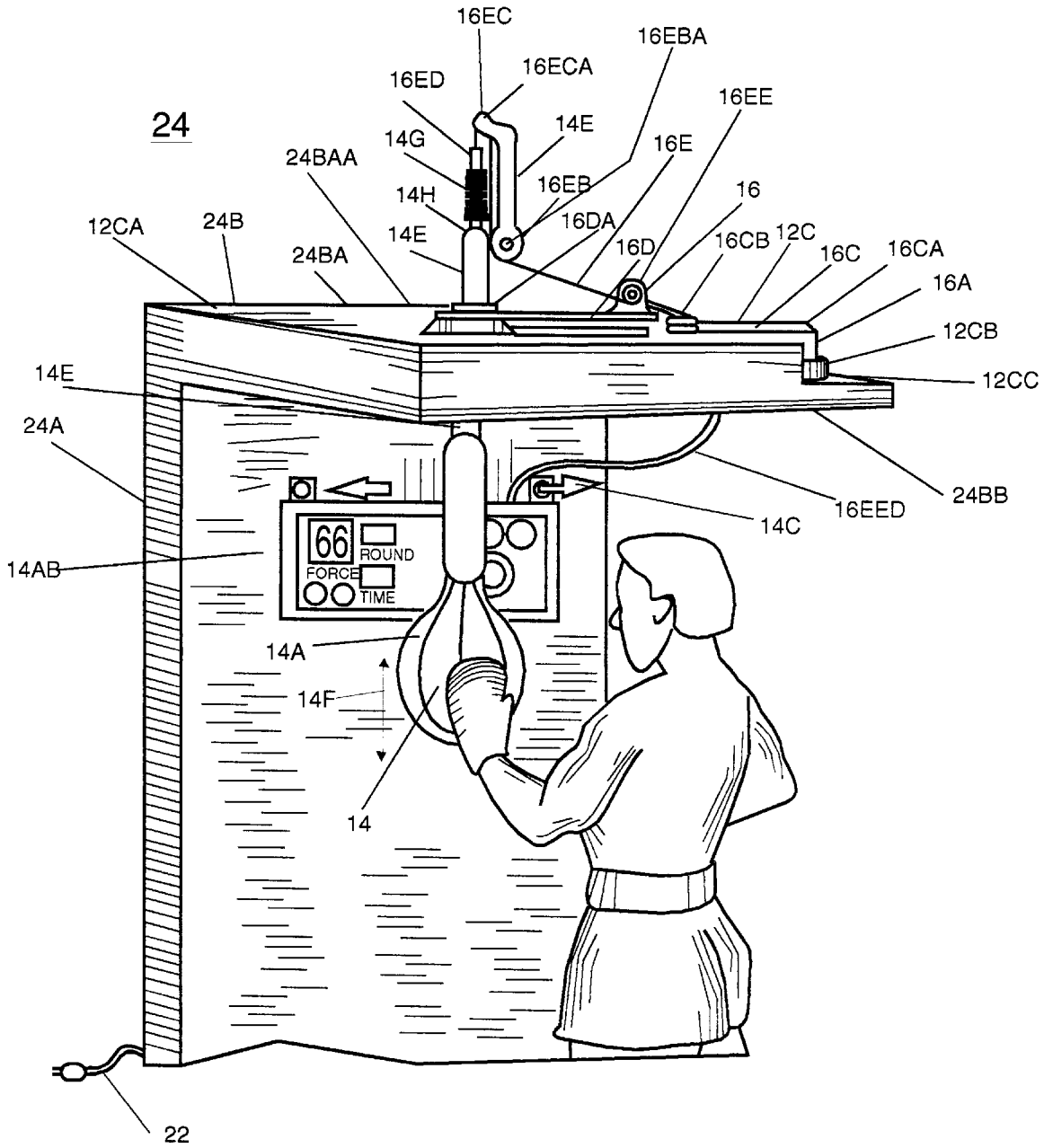
FIG. 5 is a perspective view of a programmable sparing partner as a stand along unit.

Referring to FIG. 5 which is a perspective view of a programmable sparing partner (10) incorporated in a stand alone housing (24) exhibiting the following features: motion control support member (12C), motion control horizontal support member (12CA), motion control vertical motor support (12CB), motion control horizontal motor support (12CC), target article (14), boxing bag (14A), flex spring padding (14AB), boxing bag traverse motion (14C), boxing bag vertical return spring (14G), boxing bag shaft (14H), drive means (16), drive means motor (16A), drive means rotational linkage (16C), drive means rotational linkage motor coupling (16CA), drive means rotational linkage linear coupling (16CB), drive means linear linkage (16D), drive means linear linkage boxing bag coupling (16DA), drive means boxing bag vertical position control means (16E), drive means boxing bag vertical position control cable (16EA), drive means boxing bag vertical position control first pulley (16EB), drive means boxing bag vertical position control first pulley pin (16EBA), drive means boxing bag vertical position control second pulley (16EC), drive means boxing bag vertical position control second pulley pin (16ECA), drive means boxing bag vertical position control coupling attachment means (16ED), drive means boxing bag vertical position control motor (16EE), drive means boxing bag vertical position control motor reel (16EEA), drive means boxing bag vertical position control motor flange (16EEB), drive means boxing bag vertical position control motor shaft (16EEC), drive means boxing bag vertical position control motor control cable (16EED), control panel (18), rear cover (1 8A), front panel (18B), front panel punch force display (18BA), front panel round display (18BB), front panel score display (18BC), front panel timer display (18BD), front panel punch counter (18BE), front panel speed control (18BF), front panel starting means (18BG), front panel stopping means (18BH), front panel easy difficulty selection means (18BI), front panel moderate difficulty selection means (18BJ), front panel hard difficulty selection means (18BK), housing (24), housing vertical support (24A), housing horizontal support (24B), housing horizontal support top cover (24BA), housing horizontal support target article motion slot (24BAA), housing horizontal support lower member (24BB), and housing base (24C).

The programmable sparing partner (10) is shown configured as a housing (24) suitable for home use and gym use. The housing (24) further comprises a housing vertical support (24A) which is securely attached at an upper distal end to a housing horizontal support (24B). The housing horizontal support (24B) encloses the motion control support member (12C) with a housing horizontal support top cover (24BA) having a housing horizontal support target article motion slot (24BAA) in which the target article (14) may move and housing horizontal support lower member (24BB) functioning to support the motion control support member (12C). The lower distal end of the housing vertical support (24A) is securely fastened to a housing base (24C) functioning to provide a base on which a boxer can stand and provide a cantilever action to keep the programmable sparing partner (10) from tipping over.

The motion control support member (12C) comprises: a motion control horizontal support member (12CA) functioning as a mounting means for a target article (14) and drive means (16). The motion control horizontal support member (12CA) is securely fastened on a right distal end to an upper distal end of a motion control vertical motor support (12CB). The lower distal end of the motion control vertical motor support (12CB) is securely attached to a left distal end of a motion control horizontal motor support (12CC).

The motion control horizontal support member (12CA) further comprises a motion control track which may be selected from group of tracks including: motion control linear track (12CD), second motion control serpentine track (212CD), and third motion control variable track (312CD) that function to guide a target article (14) through a motion along a boxing bag traverse motion (14C) line. The target article (14) comprises: a boxing bag (14A) securely attached to a flex spring (14AA). The flex spring (14AA) functions to provide resistance to punches and returns the boxing bag (14A) to a starting position. The flex spring (14AA) is enwrapped by a flex spring padding (14AB) functioning to protect the spring from damage.

The boxing bag (14A) is securely attached to a lower distal end of a flex spring (14AA). The upper distal end of the flex spring (14AA) is securely attached to a lower distal end of a boxing bag shaft (14H), an upper distal end of the boxing bag shaft (14H) is securely attached to a lower distal end of a support eye (14AC). The lower distal end of a support eye (14AC) is further securely attached to an upper distal end of a lower distal boxing bag vertical return spring (14G). The opposite distal end of the boxing bag vertical return spring (14G) is securely attached to the upper distal end of the boxing bag vertical column (14E). The boxing bag vertical return spring (14G) functions to force the boxing bag shaft (141) downwardly when the tension on the drive means boxing bag vertical position control cable (16EA) is relaxed.

The boxing bag shaft (14H) is slidably attached to the boxing bag upper vertical transport bearing (14DA) and boxing bag lower vertical transport bearing (14DB). The upper distal end of the support eye (14AC) is attached to a drive means (16) which functions to provide up/down motion along a boxing bag vertical motion (14F) line to the boxing bag (14A) making the boxing bag (14A) difficult to hit.

A drive means (16) comprises: a drive means motor (16A), a drive means motor control cable (16B), a drive means rotational linkage (16C), a drive means linear linkage (16D), and a drive means boxing bag vertical position control means (16E). The drive means (16) functions to move the target article (14) vertically and horizontally making the target article (14) more difficult to hit. A drive means motor (16A) is securely attached at a lower distal end to a drive means motor mounting flange (16AB). The drive means motor mounting flange (16AB) is securely attached to the motion control horizontal motor support (12CC) by a plurality of drive means motor fastenings (20B). The upper distal end of the drive means motor (16A) comprises a drive means motor shaft (16AA) securely attached to a drive means rotational linkage motor coupling (16CA) which is securely attached to one distal end of a drive means rotational linkage (16C). The opposite distal end of the drive means rotational linkage (16C) is rotationally attached to a drive means rotational linkage linear coupling (16CB) which is rotationally attached to one distal end of a drive means linear linkage (16D). The opposite distal end of the drive means linear linkage (16D) is rotationally attached to a drive means linear linkage boxing bag coupling (16DA) which is securely affixed to the boxing bag upper vertical transport bearing (14DA).

The securely fastened to the drive means linear linkage (16D) by a plurality of drive means boxing bag vertical position control motor fastenings (20C) is a drive means boxing bag vertical position control motor flange (16EEB). The drive means boxing bag vertical position control motor flange (16EEB) is securely attached to a drive means boxing bag vertical position control motor (16EE) rotationally attached to a drive means boxing bag vertical position control motor shaft (16EEC). The drive means boxing bag vertical position control motor shaft (16EEC) is securely attached to a drive means boxing bag vertical position control motor reel (16EEA).

The drive means boxing bag vertical position control motor (16EE) is electronically connected to a drive means boxing bag vertical position control motor control cable (16EED). Electronic signals are sent from the control panel (18) which function to make the drive means boxing bag vertical position control motor (16EE) run forward or backwards which rotates the drive means boxing bag vertical position control motor shaft (16EEC) and the drive means boxing bag vertical position control motor reel (16EEA). The rotational movement of the drive means boxing bag vertical position control motor reel (16EEA) pays in and out the drive means boxing bag vertical position control cable (16EA) functioning to move the target article (14) up and down along the boxing bag vertical motion (14F).

The drive means boxing bag vertical position control motor reel (16EEA) is securely attached to a drive means boxing bag vertical position control cable (16EA) on one distal end. The drive means boxing bag vertical position control cable (16EA) at a first medial point is wound about a drive means boxing bag vertical position control first pulley (16EB) which is rotationally attached to a boxing bag vertical column pulley support (14EA) by a drive means boxing bag vertical position control first pulley pin (16EBA). The drive means boxing bag vertical position control cable (16EA) at a second medial point is wound about a drive means boxing bag vertical position control second pulley (16EC) which is rotationally attached to a boxing bag vertical column pulley support (14EA) by a drive means boxing bag vertical position control second pulley pin (16ECA). The opposite distal end of the drive means boxing bag vertical position control cable (16EA) is securely attached to a drive means boxing bag vertical position control coupling attachment means (16ED) which is securely attached to a support eye (14AC).

The drive means boxing bag vertical position control motor control cable (16EED) and the drive means motor control cable (16B) are electronically connected to a control panel (18).

The control panel (18) comprises a front panel (18B) removably attached to the housing vertical support (24A). The front panel (18B) functions as a mounting means for indicator means and control means. The front panel (18B) comprises a front panel punch force display (18BA) securely mounted thereon, functioning to display the force of each punch delivered to the boxing bag (14A).The front panel (18B) comprises a front panel round display (18BB) securely mounted thereon, functioning to display the round number. The front panel (18B) comprises a front panel score display (18BC) securely mounted thereon, functioning to display the score the user receives. The front panel (18B) comprises a front panel timer display (18BD) securely mounted thereon, functioning to display the time remaining in a round. The front panel (18B) comprises a front panel punch counter (18BE) securely mounted thereon, functioning to display number of punches. The front panel (18B) comprises a front panel speed control (18BF) securely mounted thereon, functioning to display the speed of movement at which the target article (14) progresses along the motion control linear track (12CD). The front panel (18B) comprises a front panel starting means (18BG) securely mounted thereon, functions to turn on the programmable sparing partner (10). The front panel (18B) comprises a front panel stopping means (18BH) securely mounted thereon, functions to turn off the programmable sparing partner (10). The front panel (18B) comprises a front panel easy difficulty selection means (18BI) securely mounted thereon, functions to select an easy difficulty mode. The front panel (18B) comprises a front panel moderate difficulty selection means (18BJ) securely mounted thereon, functions to select a moderate difficulty mode. The front panel (18B) comprises a front panel hard difficulty selection means (18BK) securely mounted thereon, functions to select a hard difficulty mode. The user interface knobs and buttons are large enough to be pushed while wearing boxing gloves.

A power means (22) is electronically connected to the control panel (18) functioning to provide electrical power to the programmable sparing partner (10).

Figure 6:
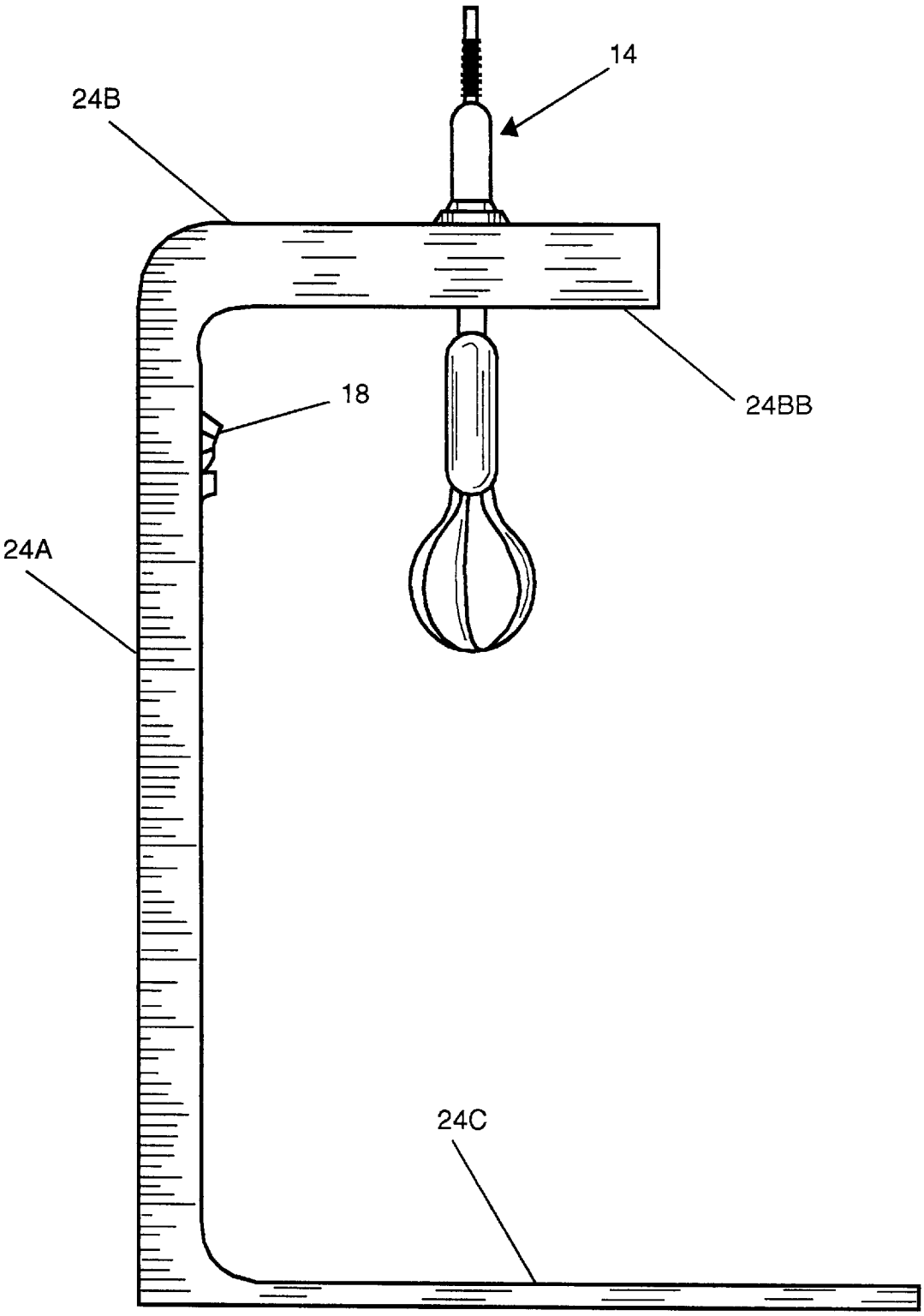
FIG. 6 is a side view of a programmable sparing partner as a stand along unit.

Lastly, referring to FIG. 6 which is a side view of a programmable sparing partner (10) as a stand along unit exhibiting the following features: target article (14), control panel (18), housing (24), housing vertical support (24A), housing horizontal support (24B), and housing base (24C)

The housing (24) comprises; a housing base (24C) securely attached at a left distal end to a housing vertical support (24A). The housing vertical support (24A) has the control panel (18) mounted thereon. The upper distal end of the housing vertical support (24A) is securely attached to the housing horizontal support (24B). The programmable sparing partner (10) is enclosed therein, having a target article mounted thereon.

I claim:

1. A programmable sparing partner (10) comprising:

A) a support structure (12) which comprises: a left vertical support member (12A) securely attached to a left distal end of a motion control support member (12C), a right distal end of the motion control support member (12C) is securely attached to a right vertical support member (12B), the motion control support member (12C) functions to support a motion means propelling a target article (14) along a prescribed path, the motion control support member (12C) comprises a motion control horizontal support member (12CA) securely attached on one distal end to an upper distal end of a motion control vertical motor support (12CB), the motion control vertical motor support (12CB) is attached at a lower distal end to a motion control horizontal motor support (12CC) functioning to support a drive means motor (16A) thereon, the motion control horizontal motor support (12CC) further comprises a motion control linear track (12CD) functioning to guide the motion of the target article (14);

B) a target article (14) movably mounted upon the motion control support member (12C), the target article (14) comprises a boxing bag (14A) movably mounted thereon, the boxing bag (14A) comprises a boxing bag impact sensor (14B) securely mounted within the boxing bag (14A), the boxing bag impact sensor (14B) is electronically connected to the control panel (18) by a boxing bag impact sensor data wire (14BA), the boxing bag impact sensor (14B) functions to send electronic signals to the control panel (18) proportional to the force of the punch delivered to the boxing bag (14A), the boxing bag impact sensor (14B) provides a means of counting the number of punches hitting the boxing bag (14A);

C) a drive means (16) attached to and functioning to move the target article (14) in a vertical and horizontal direction;

D) a control panel (18) electronically connected to the drive means (16) functioning to control motion of the target article (14); and E) a power means (22) electrically connected to the control panel (18) functioning to provide power thereto.

2. The programmable sparing partner (10) as described in claim 1, wherein the drive means (16) comprises a drive means motor (16A) securely attached to a drive means motor mounting flange (16AB) functioning to securely fasten the drive means motor (16A) to the motion control horizontal motor support (12CC) by at least one drive means motor fasteners (20B), the drive means motor (16A) further comprises; a drive means motor shaft (16AA) which is securely fastened to a drive means rotational linkage motor coupling (16CA) which is securely fastened to one distal end of a drive means rotational linkage (16C), the opposite distal end of the drive means rotational linkage (16C) is rotationally attached to a drive means rotational linkage linear coupling (16CB), the drive means rotational linkage linear coupling (16CB) is securely attached to one distal end of a drive means linear linkage (16D), the opposite distal end of the drive means linear linkage (16D) is attached to a drive means linear linkage boxing bag coupling (16DA) which is rotationally attached to a boxing bag transport bearing (14D), the drive means motor (16A) functions, via mechanical linkages, to move the target article (14) along a boxing bag traverse motion (14C), the drive means motor (16A) further has a drive means motor control cable (16B) electrically connected to the control panel (18).

3. The programmable sparing partner (10) as described in claim 1, wherein the drive means (16) further comprises a drive means boxing bag vertical position control means (16E) having a drive means boxing bag vertical position control motor (16EE) rotatably enclosing a drive means boxing bag vertical position control motor shaft (16EEC) and a drive means boxing bag vertical position control motor flange (16EEB) which is securely fastened to a drive means linear linkage (1 6D) by a plurality of drive means boxing bag vertical position control motor fastenings (20C), the drive means boxing bag vertical position control motor shaft (16EEC) is securely attached on one distal end to a drive means boxing bag vertical position control motor reel (16EEA) which has one distal end of a drive means boxing bag vertical position control cable (16EA) wound thereabout, an opposite distal end of the drive means boxing bag vertical position control cable (16EA) is securely attached by a drive means boxing bag vertical position control coupling attachment means (16ED) to a boxing bag shaft (14H), the drive means boxing bag vertical position control cable (16EA) is guided at medial distal points to the boxing bag shaft (14H) by drive means boxing bag vertical position control first pulley (16EB) and a drive means boxing bag vertical position control second pulley (16EC), a boxing bag vertical return spring (14G) is attached on one distal end to a boxing bag vertical column (14E) and attached on an opposite distal end to the boxing bag shaft (14H) which functions to tension the boxing bag vertical position control cable (1 6EA), when the boxing bag vertical position control cable (16EA) is wound up and wound down by the drive means boxing bag vertical position control motor (16EE), the boxing bag (14A) moves up and down in response thereto, the drive means boxing bag vertical position control motor (16EE) is electronically connected to the control panel (18) by a drive means boxing bag vertical position control motor control cable (16EED) which functions to carry signals sent by the control panel (18) to the drive means boxing bag vertical position control motor (16EE) functioning to move the boxing bag (14A) along a boxing bag vertical motion (14F).

4. The programmable sparing partner (10) as described in claim 1, wherein the control panel (18) comprises a front panel (18B) which comprises a front panel punch force display (18BA) which functions to display a force of a boxer's punch, a front panel round display (18BB) which functions to display a number of a round, a front panel score display (18BC) which functions to display score a boxer has accumulated, a front panel timer display (18BD) which functions to display the time remaining in the round, a front panel punch counter (18BE) which functions to display the number of times the boxing bag impact sensor (14B) has recorded a hit, a front panel speed control (18BF) which functions to regulate the speed of play, a front panel starting means (18BG) which functions to start the programmable sparing partner (10), a front panel stopping means (18BH) which functions to stop the programmable sparing partner (10), front panel easy difficulty selection means (18BI) which functions to change the speed and motion characteristics of the target article (14), a front panel moderate difficulty selection means (18BJ) which functions to change the speed and motion characteristics if the target article (14), and a front panel hard difficulty selection means (18BK) which functions to change the speed and motion characteristics if the target article (14).

5. The programmable sparing partner (10) as described in claim 1, wherein the programmable sparing partner (10) is mounted in a housing (24) which comprises a housing base (24C) which is securely attached to a housing vertical support (24A) on a lower distal end, an upper distal end of the housing vertical support (24A) is securely attached to a housing horizontal support (24B), the housing horizontal support (24B) comprises a housing horizontal support top cover (24BA) having a housing horizontal support target article motion slot (24BAA) therein which functions to provide clear passage for the target article (14), and a housing horizontal support lower member (24BB) which functions to support a motion control support member (12C), the housing (24) functions as a free standing device suitable for installation in a home and professional gym without modification of building structure.

6. The programmable sparing partner (10) as described in claim 1, wherein the motion control horizontal support member (12CA) is a second motion control serpentine track (212CD), functioning to provide a serpentine motion to the target article (14).

7. The programmable sparing partner (10) as described in claim 1, wherein the motion control horizontal support member (12CA) is a third motion control variable track (312CD), functioning to provide a variable motion to the target article (14).

* * * * *